US011397390B2

(12) United States Patent
Kim et al.

(10) Patent No.: US 11,397,390 B2
(45) Date of Patent: Jul. 26, 2022

(54) TONER REFILL CARTRIDGE WITH A SPIRAL PORTION TO MOVE A PLUNGER

(71) Applicant: Hewlett-Packard Development Company, L.P., Spring, TX (US)

(72) Inventors: Junhui Kim, Pangyo (KR); Sanghoon Lee, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/311,801

(22) PCT Filed: Jan. 3, 2020

(86) PCT No.: PCT/US2020/012168
§ 371 (c)(1),
(2) Date: Jun. 8, 2021

(87) PCT Pub. No.: WO2021/034343
PCT Pub. Date: Feb. 25, 2021

(65) Prior Publication Data

US 2022/0171309 A1 Jun. 2, 2022

(30) Foreign Application Priority Data

Aug. 20, 2019 (KR) ..... 10-2019-0101716

(51) Int. Cl.
*G03G 15/08* (2006.01)
*G03G 21/18* (2006.01)

(52) U.S. Cl.
CPC ..... *G03G 15/087* (2013.01); *G03G 15/0894* (2013.01); *G03G 21/181* (2013.01); *G03G 2215/00987* (2013.01)

(58) Field of Classification Search
CPC ..... G03G 15/087; G03G 15/0894; G03G 21/181; G03G 2215/00987
See application file for complete search history.

(56) References Cited

U.S. PATENT DOCUMENTS 7,853,184 B2 12/2010 Taguchi et al.
9,383,679 B2 7/2016 Eto
(Continued)

FOREIGN PATENT DOCUMENTS

CN 100422869 C 10/2008
EP 1076271 A1 2/2001
(Continued)

*Primary Examiner* — Susan S Lee
(74) *Attorney, Agent, or Firm* — Jefferson IP Law, LLP

(57) ABSTRACT

An example toner refill cartridge includes a body including a toner accommodating portion to accommodate toner and a toner discharge port provided at an end portion of the body in a longitudinal direction to be in communication with the toner accommodating portion, a first member rotatably supported by the body and having a spiral portion extending in the longitudinal direction, a second member located inside the first member and having a guide groove extending in the longitudinal direction, and a plunger having a guide protrusion which passes through the guide groove to engage the spiral portion, to push the toner inside a toner accommodating portion toward a toner discharge port while being moved in the longitudinal direction as the first member is rotated.

15 Claims, 9 Drawing Sheets

(56) References Cited

U.S. PATENT DOCUMENTS

| | | | | |
|---|---|---|---|---|
| 9,753,402 | B2 * | 9/2017 | Murakami | G03G 15/0872 |
| 2018/0356749 | A1 * | 12/2018 | Eto | G03G 15/0889 |

FOREIGN PATENT DOCUMENTS

| | | | |
|---|---|---|---|
| JP | H03118569 | A | 5/1991 |
| JP | H06222663 | A | 8/1994 |
| JP | 2000155459 | A | 6/2000 |
| JP | 3982865 | B2 | 9/2007 |
| KR | 20030087788 | A | 11/2003 |
| KR | 101076035 | B1 | 10/2011 |

* cited by examiner

TONER REFILL CARTRIDGE WITH A SPIRAL PORTION TO MOVE A PLUNGER

BACKGROUND

An image forming apparatus using an electrophotographic method forms a visible toner image on a photoconductor by supplying toner to an electrostatic latent image formed on the photoconductor, transfers the toner image to a print medium directly or through an intermediate transfer medium, and fixes the transferred toner image to the print medium.

A developing cartridge accommodates toner and supplies the toner to an electrostatic latent image formed on the photoconductor to form a visible toner image. When the toner accommodated in the developing cartridge is used up, the developing cartridge may be removed from a main body of the image forming apparatus, and a new developing cartridge may be mounted on the main body. A toner refill cartridge may also be used to fill the developing cartridge with new toner.

DETAILED DESCRIPTION OF EXAMPLES

Figure 1:
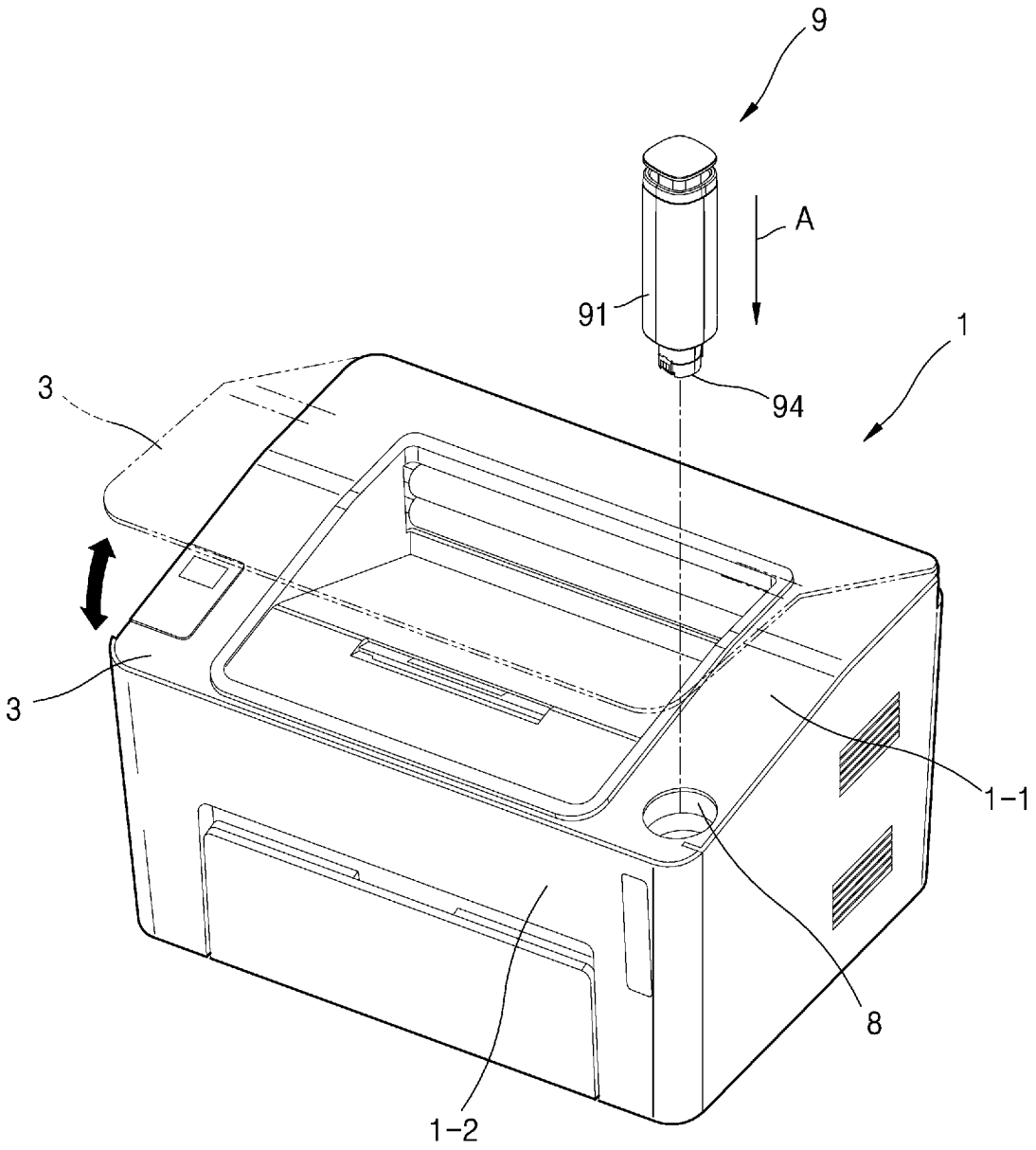
FIG. 1 is a schematic external perspective view of an electrophotographic image forming apparatus according to an example.

Reference will now be made to examples that are illustrated in the accompanying drawings. The same reference numerals are used to denote the same elements, and repeated descriptions thereof will not be given herein.

Figure 2:
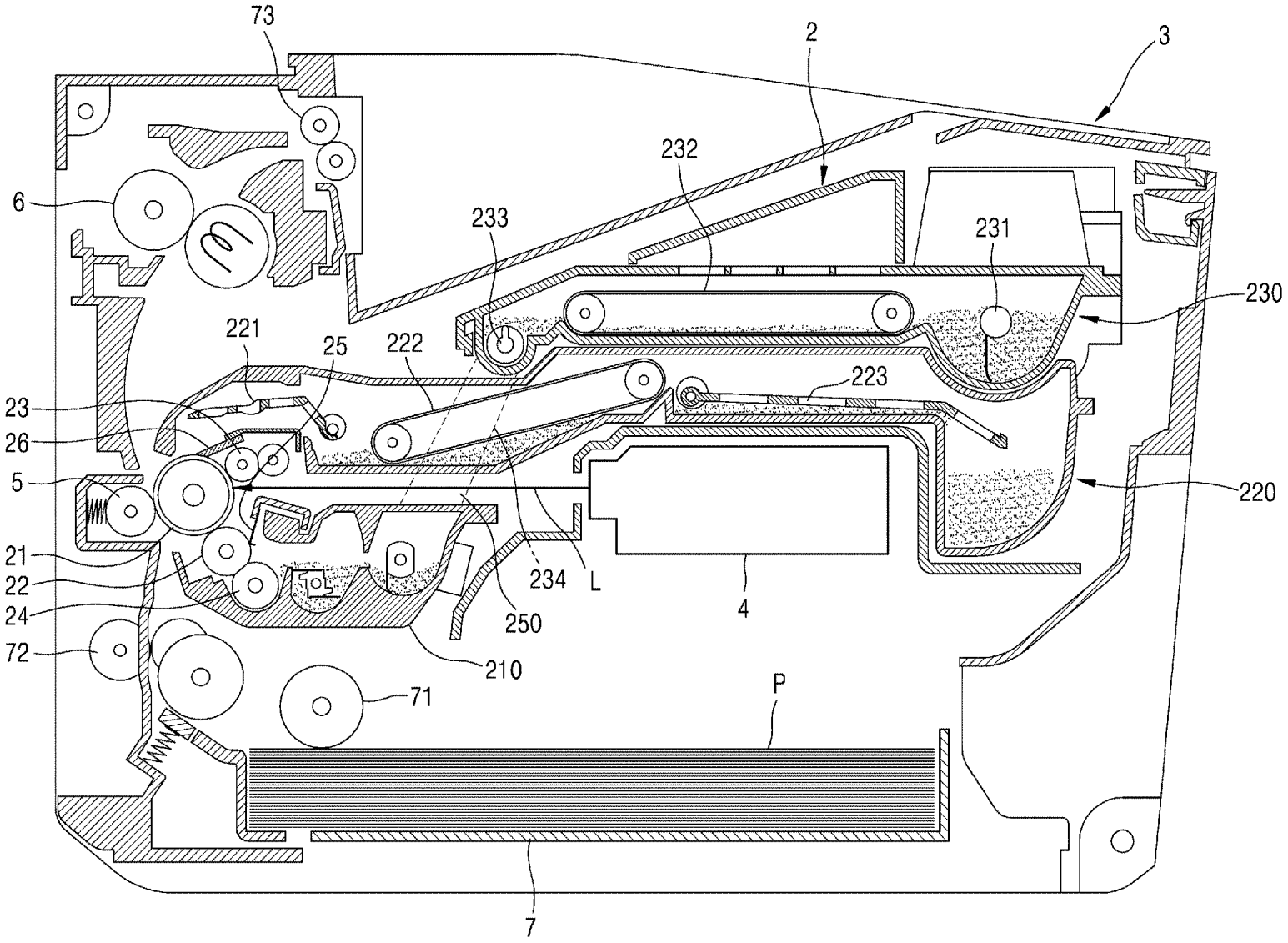
FIG. 2 is a schematic block diagram of an electrophotographic image forming apparatus according to an example.
Figure 3:
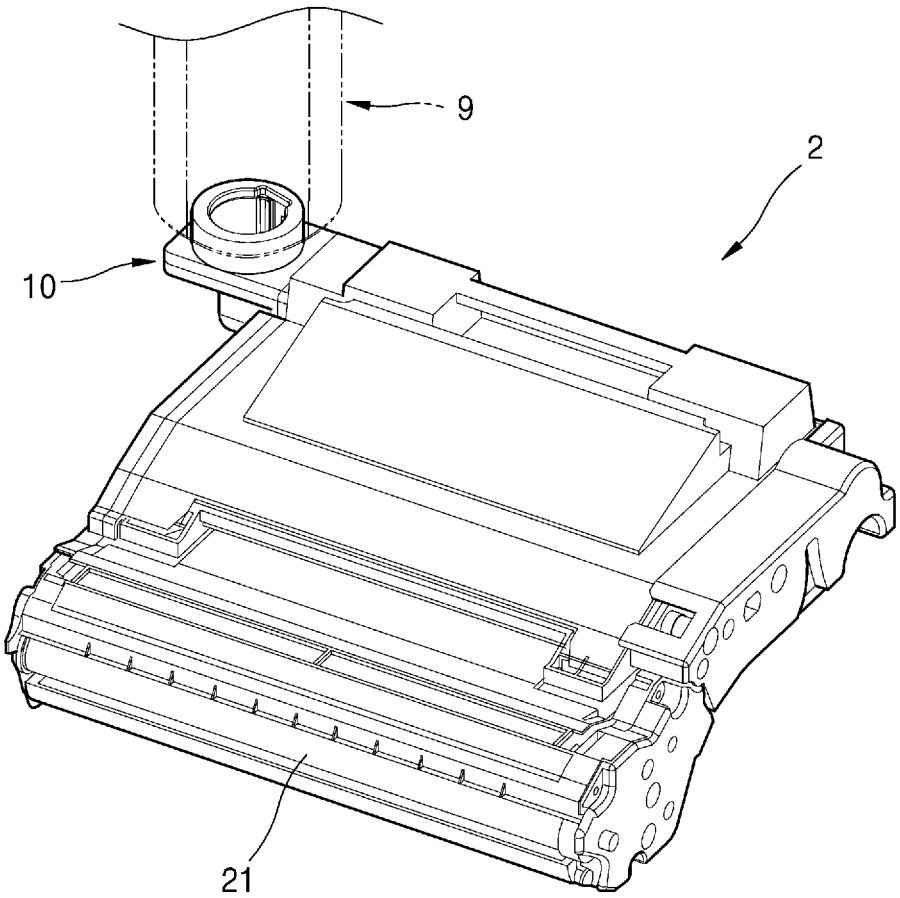
FIG. 3 is a perspective view of a developing cartridge according to an example.

FIG. 1 is a schematic external perspective view of an electrophotographic image forming apparatus according to an example. FIG. 2 is a schematic block diagram of an electrophotographic image forming apparatus according to an example. FIG. 3 is a perspective view of a developing cartridge according to an example.

Referring to FIGS. 1, 2, and 3, an electrophotographic image forming apparatus may include a main body 1 and a developing cartridge 2 in a cartridge form detachable from the main body 1. A door 3 may be provided in the main body 1. The door 3 may open and close a part of the main body 1. In the example of FIG. 1, the door 3 opens an upper part of the main body 1. However, a door which opens a side part or a front part of the main body 1 may be employed as needed. The developing cartridge 2 may be mounted on and/or detached from the main body 1 by opening the door 3.

A photosensitive drum 21 is one example of a photoconductor on which an electrostatic latent image may be formed. The photosensitive drum 21 may include a cylindrical metal pipe and a photosensitive layer having photoconductivity formed on an outer circumference thereof. A charging roller 23 is one example of a charger to charge the surface of the photosensitive drum 21 to a uniform electric potential. A charging bias voltage may be applied to the charging roller 23. In an example, a corona charger (not shown) may be used instead of the charging roller 23. A developing roller 22 may supply toner to an electrostatic latent image formed on the surface of the photosensitive drum 21 and develop the electrostatic latent image.

In the case of a two-component developing method using toner and a carrier as a developing agent, the developing roller 22 may include a rotatable sleeve and a magnet fixedly (e.g., not to be rotated) installed on the inner side of the sleeve. The sleeve may be spaced several tens to hundreds of micrometers apart from the photosensitive drum 21. The carrier may be attached to an outer circumference of the developing roller 22 by a magnetic force of the magnet, and the toner may be attached to the carrier by an electrostatic force, such that a magnetic brush made of the carrier and the toner is formed on the outer circumference of the developing roller 22. Only the toner is moved to the electrostatic latent image formed on the photosensitive drum 21 by the developing bias voltage applied to the developing roller 22.

In the case of a one-component developing method using toner as a developing agent, the developing roller 22 may be in contact with the photosensitive drum 21 or may be spaced several tens to hundreds of micrometers apart from the photosensitive drum 21. In this example, a one-component contact developing method is adopted in which the developing roller 22 and the photosensitive drum 21 are in contact with each other to form a development nip. The developing roller 22 may have an elastic layer (not shown) formed on an outer circumference of a conductive metal core (not shown). When the developing bias voltage is applied to the developing roller 22, the toner is moved and attached to the electrostatic latent image formed on the photosensitive drum 21 through the development nip.

A supply roller 24 may attach the toner to the developing roller 22. A supply bias voltage may be applied to the supply roller 24 to attach the toner to the developing roller 22. A regulating member 25 is provided to regulate an amount of toner attached to the surface of the developing roller 22. The regulating member 25 may be, for example, a regulating blade having a tip that is in contact with the developing roller 22. A cleaning member 26 is provided to remove residual toner and foreign matter from the surface of the photosensitive drum 21 before charging. The cleaning member 26 may be, for example, a cleaning blade whose tip is in contact with the surface of the photosensitive drum 21. Hereinafter, the foreign substance removed from the surface of the photosensitive drum 21 is referred to as waste toner.

An optical scanner 4 may irradiate light modulated according to image information onto the surface of the photosensitive drum 21 charged at a uniform electric potential. For example, a laser scanning unit (LSU) which scans the photosensitive drum 21 by deflecting light emitted from a laser diode in a main scanning direction using a polygon mirror may be employed as the optical scanner 4.

A transfer roller 5 is one example of a transfer unit which is positioned to face the photosensitive drum 21 to form a transfer nip. A transfer bias voltage for transferring a toner image developed on the surface of the photosensitive drum 21 to a print medium P is applied to the transfer roller 5. A corona transfer unit may be used instead of the transfer roller 5.

The toner image transferred to the surface of the print medium P by the transfer roller 5 is maintained on the surface of the print medium P by electrostatic attraction. A fusing unit 6 forms a permanent printed image on the print medium P by applying heat and pressure to the toner image to be fixed on the print medium P.

Referring to FIGS. 2 and 3, the developing cartridge 2 may include a developing portion 210 in which the photosensitive drum 21 and the developing roller 22 are installed, a waste toner chamber 220 to accommodate waste toner removed from the photosensitive drum 21, and a toner accommodating portion 230 connected to the developing portion 210 to accommodate the toner. To refill the toner in the toner accommodating portion 230, the developing cartridge 2 is provided with a toner filling portion 10 connected to the toner accommodating portion 230. The toner filling portion 10 provides an interface between a toner refill cartridge 9 and the developing cartridge 2. The developing cartridge 2 may be an integrated developing cartridge including the developing portion 210, the waste toner chamber 220, the toner accommodating portion 230, and the toner filling portion 10.

A part of an outer circumference of the photosensitive drum 21 is exposed to an outer side of a housing of the developing cartridge 2. The transfer roller 5 may be in contact with the exposed part of the photosensitive drum 21 to form a transfer nip. One or more conveying members for conveying the toner toward the developing roller 22 may be installed in the developing portion 210. The conveying member may serve to stir the toner to charge the toner to a certain electric potential.

The waste toner chamber 220 is positioned at an upper side of the developing portion 210. The waste toner chamber 220 is spaced upward from the developing portion 210 to form an optical path 250 therebetween. The waste toner removed from the photosensitive drum 21 by the cleaning member 26 is accommodated in the waste toner chamber 220. The waste toner removed from the photosensitive drum 21 is transferred into the waste toner chamber 220 by one or more waste toner conveying members 221, 222, and 223. The shape and number of waste toner conveying members are not particularly limited. An appropriate number of waste toner conveying members may be installed at appropriate positions to effectively disperse the waste toner inside the waste toner chamber 220 in consideration of the volume or shape of the waste toner chamber 220.

The toner accommodating portion 230 is connected to the toner filling portion 10 to accommodate the toner. The toner accommodating portion 230 is connected to the developing portion 210 by a toner supply portion 234 as shown by a dotted line in FIG. 2. As shown in FIG. 2, the toner supply portion 234 may be connected to the developing portion 210 by penetrating the waste toner chamber 220 in a vertical direction. The toner supply portion 234 is located outside an effective width of an exposure light L so as not to interfere with the exposure light L scanned in the main scanning direction by the optical scanner 4.

The toner accommodating portion 230 may be provided with one or more toner supply members 231, 232, and 233 for supplying the toner to the developing portion 210 through the toner supply portion 234. The shape and number of toner supply members are not particularly limited. An appropriate number of toner supply members may be installed at an appropriate position in the toner accommodating portion 230 to effectively supply the toner to the developing portion 210 in consideration of the volume or shape of the toner accommodating portion 230. The toner supply member 233 may transfer the toner in the main scanning direction to the toner supply portion 234.

An example image forming process configured as above will be briefly described. A charging bias is applied to the charging roller 23 and the photosensitive drum 21 is charged to a uniform electric potential. The optical scanner 4 scans the light modulated in correspondence with image information to the photosensitive drum 21 and forms an electrostatic latent image on the surface of the photosensitive drum 21. The supply roller 24 attaches the toner to the surface of the developing roller 22. The regulating member 25 forms a toner layer of a uniform thickness on the surface of the developing roller 22. A developing bias voltage is applied to the developing roller 22. As the developing roller 22 is rotated, the toner conveyed to the development nip is moved and attached to the electrostatic latent image formed on the surface of the photosensitive drum 21 by the developing bias voltage so that a visible toner image is formed on the surface of the photosensitive drum 21. The print medium P drawn out from a loading device 7 by a pickup roller 71 is transferred by a transport roller 72 to the development nip where the transfer roller 5 and the photosensitive drum 21 are opposed to each other. When the transfer bias voltage is applied to the transfer roller 5, the toner image is transferred to the print medium P by electrostatic attraction. The toner image transferred to the print medium P is fixed to the print medium P by receiving heat and pressure from the fusing unit 6, thereby completing printing. The print medium P is discharged by a discharge roller 73. Toner remaining on the surface of the photosensitive drum 21 without being transferred to the print medium P is removed by the cleaning member 26.

As described above, the developing cartridge 2 may supply toner accommodated in the toner accommodating portion 230 to the electrostatic latent image formed on the photosensitive drum 21 to form a visible toner image. The developing cartridge 2 may be attached to and detached from the main body 1. In addition, the developing cartridge 2 is provided with the toner filling portion 10 capable of refilling the toner. The toner filling portion 10 is integrally formed with the developing cartridge 2 to be attached to or detached from the main body 1 together with the developing cartridge 2. According to the image forming apparatus in the present example, the toner may be refilled in the developing cartridge 2 in a state in which the developing cartridge 2 is mounted on the main body 1 without removing the developing cartridge 2 from the main body 1.

Referring again to FIG. 1, the toner refill cartridge 9 comprises a body 91 to accommodate toner and a toner discharge port 94. The toner discharge port 94 is provided at one end in a longitudinal direction A. The main body 1 is provided with a communication portion 8 so that the toner filling portion 10 may be accessed from the outside of the main body 1 in a state in which the developing cartridge 2 is attached to the main body 1. The communication portion 8 may be provided at a position close to a front portion 1-2 of the main body 1. As the front portion 1-2 faces a user, the user may easily access the communication portion 8. Therefore, the toner refilling operation through the communication portion 8 may be easily performed. The communication portion 8 may be provided on an upper surface 1-1 of the main body 1. The toner filling portion 10 is positioned at a lower part of the communication portion 8. The communication portion 8 and the toner filling portion 10 may be aligned with each other in a vertical direction. The toner refill cartridge 9 may access the toner filling portion 10 through the communication portion 8 from the upper side of the main body 1.

For example, when the toner refill cartridge 9 is inserted into the communication portion 8 from the upper side of the main body 1, as shown in FIG. 3, the toner refill cartridge 9 may be connected to the toner filling portion 10. When toner inside the body 91 is discharged through the toner discharge port 94 in this state, the toner may be supplied to the toner accommodating portion 230 of the developing cartridge 2 through the toner filling portion 10. The toner refill cartridge 9 is removed from the communication portion 8 after the toner is refilled.

According to this configuration, since the toner may be refilled in the toner accommodating portion 230 through the toner filling portion 10, the replacement timing of the developing cartridge 2 may be extended until the life of the photosensitive drum 21 is reached, so that the printing cost per sheet may be reduced. The toner may be refilled in a state in which the developing cartridge 2 is mounted on the main body 1, thereby improving user convenience.

As a method of discharging toner from the toner refill cartridge 9, a syringe method using a plunger (not shown) movable in the longitudinal direction A inside the body 91 may be employed. After the toner refill cartridge 9 is mounted on the communication portion 8 of the main body 1, the plunger may be pressed in the longitudinal direction A to refill the toner in the developing cartridge 2. The discharge speed of the toner through the toner discharge port 94 is proportional to the speed at which the plunger is pressed. If the plunger is pressed too quickly, an excessive amount of toner may be filled into the developing cartridge 2 at once. Also, the internal pressure of the developing cartridge 2 may be increased, and toner may leak through a weakly sealed part of the developing cartridge 2.

The toner refill cartridge 9 in this example has a structure in which the toner is discharged at an appropriate speed.

Figure 4:
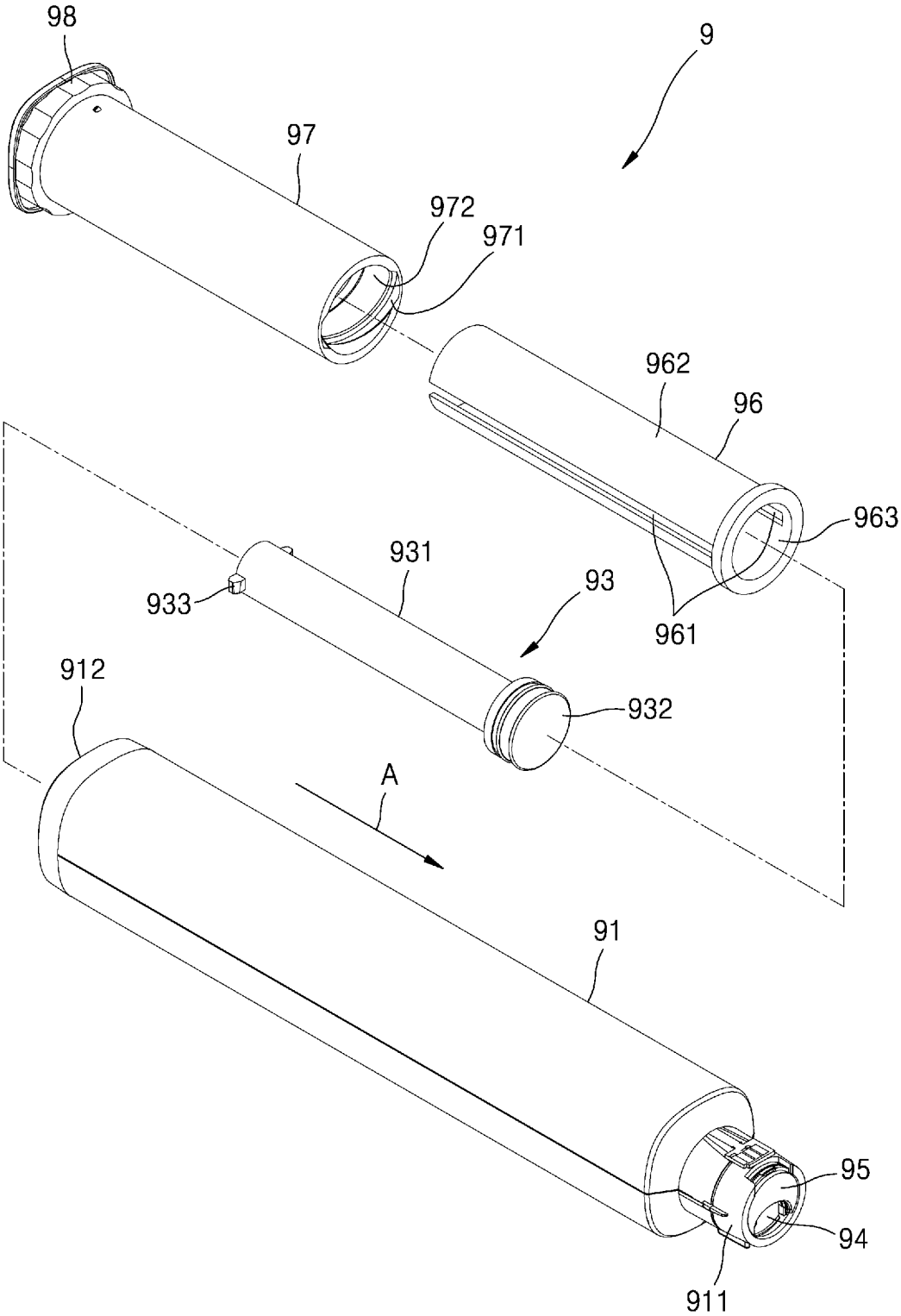
FIG. 4 is an exploded perspective view of a toner refill cartridge according to an example.
Figure 5:
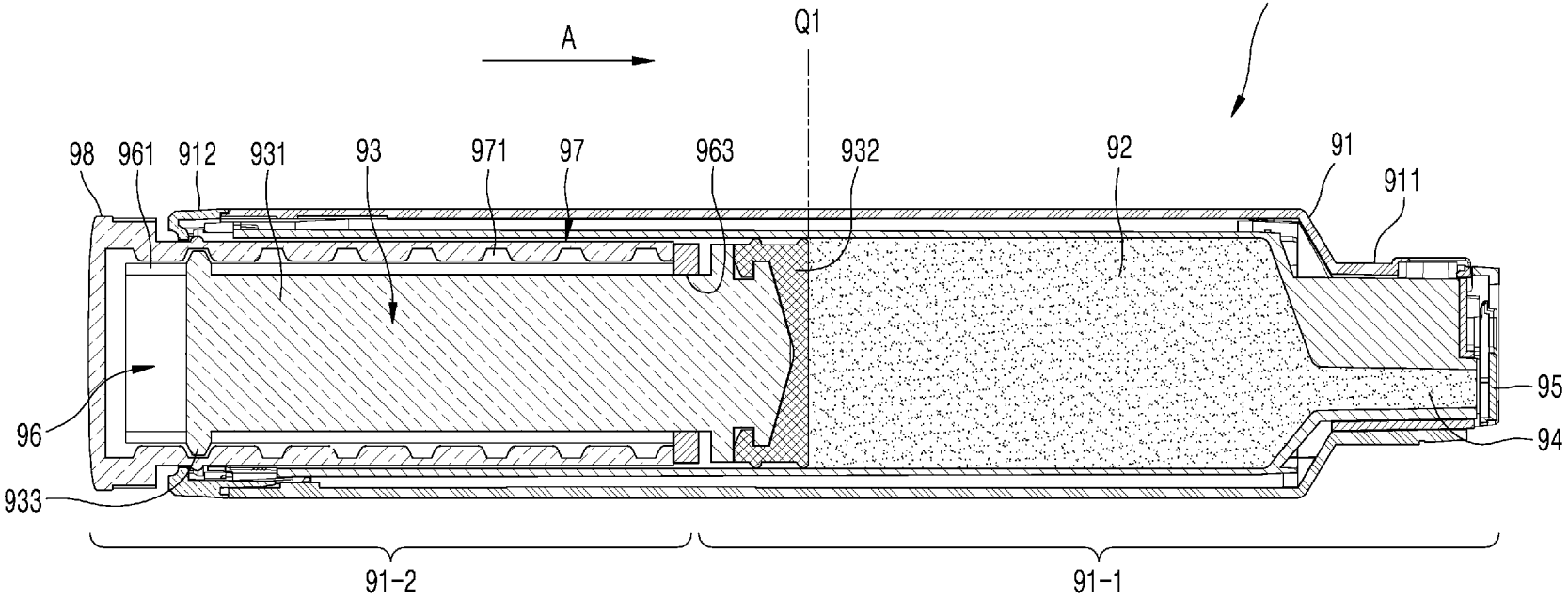
FIG. 5 is a cross-sectional view of a toner refill cartridge showing a state in which a plunger is located at a top dead position according to an example.
Figure 6:
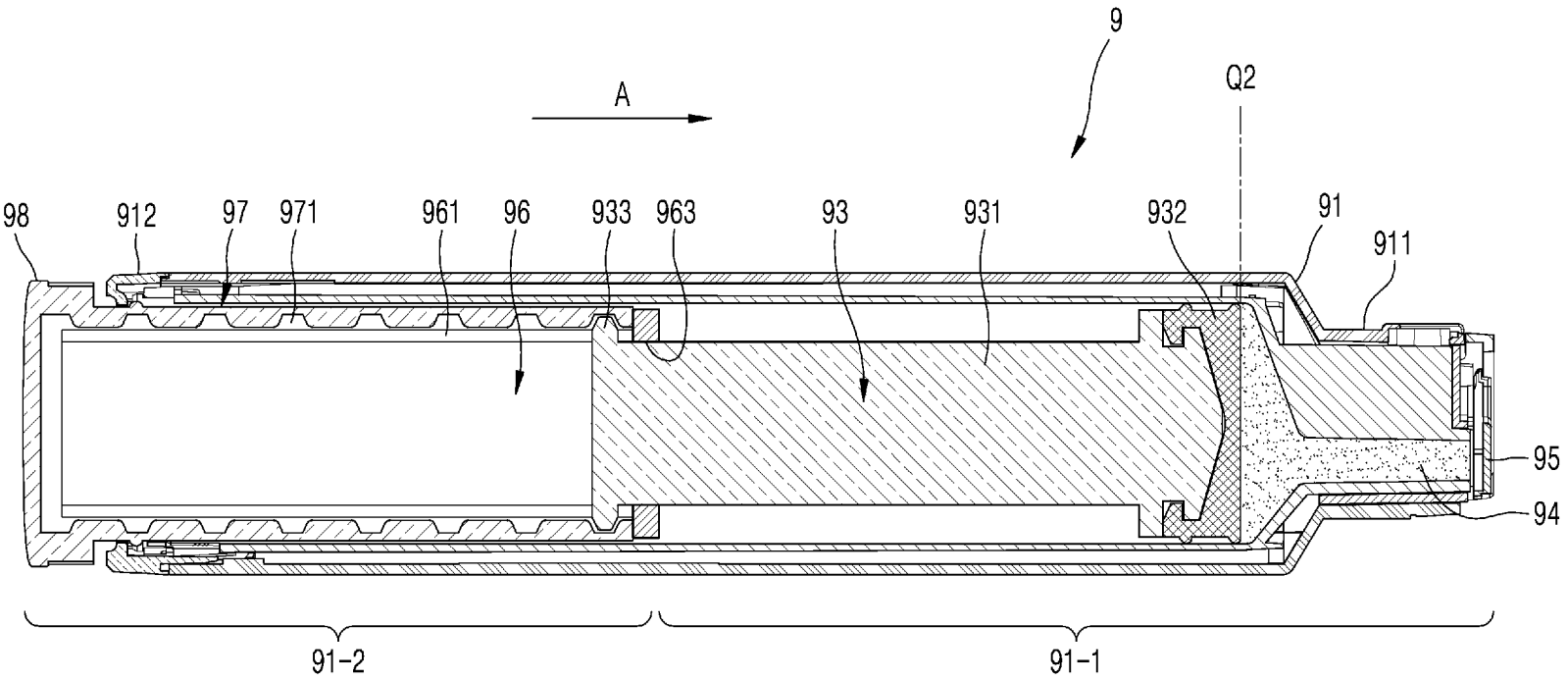
FIG. 6 is a cross-sectional view of a toner refill cartridge showing a state in which a plunger is located at a bottom dead position according to an example.

FIG. 4 is an exploded perspective view of a toner refill cartridge according to an example. FIG. 5 is a cross-sectional view of a toner refill cartridge showing a state in which a plunger is located at a top dead position according to an example. FIG. 6 is a cross-sectional view of a toner refill cartridge showing a state in which a plunger is located at a bottom dead position according to an example.

Referring to FIGS. 4 to 6, the toner refill cartridge 9 may include the body 91, a first member 97, a second member 96, and a plunger 93.

The body 91 comprises a toner accommodating portion 92 to accommodate toner and a toner discharge port 94 communicating with the toner accommodating portion 92 at an end portion 911 in the longitudinal direction A. The toner accommodating portion 92 communicates with the outside through the toner discharge port 94. A shutter 95 for selectively opening and closing the toner discharge port 94 may be provided at the end portion 911 of the body 91. For example, the shutter 95 may open the toner discharge port 94 in conjunction with an operation in which the toner refill cartridge 9 is mounted on the toner filling portion 10.

The first member 97 may be provided with a spiral portion 971 supported by the body 91 to be rotated and extending in the longitudinal direction A. The first member 97 may be inserted into the body 91 and may be supported by the body 91 to be rotated. The first member 97 may have a hollow cylindrical shape. The spiral portion 971 may be provided on an inner wall 972 of the first member 97. The spiral portion 971 extends in the longitudinal direction A. The first member 97 may include a handle 98 exposed to the outside of the body 91 so as to rotate the first member 97. The handle 98 is exposed to the outside of the body 91 through an end portion 912 of the body 91 to be held by a user's hand. The handle 98 may be integrally formed with the first member 97 or may be manufactured as a separate member and coupled to the first member 97.

The second member 96 is positioned inside the first member 97. A guide groove 961 extending in the longitudinal direction A is provided in the second member 96. The second member 96 may have a hollow cylindrical shape. The guide groove 961 may be formed by penetrating a side wall 962 of the second member 96.

The plunger 93 may be inserted into the second member 96. The plunger 93 has a guide protrusion 933 which passes through the guide groove 961 and couples with the spiral portion 971. The guide protrusion 933 may be provided near an end of the plunger 93 away from the toner accommodating portion 92. The plunger 93 may be moved in the longitudinal direction A as the first member 97 is rotated to push toner in the toner accommodating portion 92 toward the toner discharge port 94.

The toner refill cartridge 9 in this example has a structure in which the toner accommodating portion 92 is formed by the body 91. The body 91 has a first portion 91-1 and a second portion 91-2. The first portion 91-1 and the second portion 91-2 extend in the longitudinal direction A. The first portion 91-1 comprises the toner accommodating portion 92. The toner discharge port 94 is provided at the end portion 911 of the first portion 91-1. The second portion 91-2 accommodates the first member 97, the second member 96, and the plunger 93. The second portion 91-2 extends in an opposite direction of the toner discharge port 94 from the first portion 91-1. The handle 98 is exposed to the outside through the end portion 912 of the second portion 91-2.

The plunger 93 may include a piston 931 and a packing member 932. The piston 931 includes the guide protrusion 933. The guide protrusion 933 may be provided near an end of the plunger 93 opposite to the packing member 932. The piston 931 extends from the inner side of the second member 96 to the inner side of the toner accommodating portion 92. A communication port 963 through which the piston 931 passes is provided at an end of the second member 96 on the toner accommodating portion 92. The packing member 932 is provided at an end of the piston 931, that is, the end on the toner accommodating portion 92. The packing member 932 is in contact with an inner wall of the toner accommodating portion 92. The packing member 932 pushes the toner contained in the toner accommodating portion 92 toward the toner discharge port 94 when the plunger 93 is moved in the longitudinal direction A toward the end portion 911. The packing member 932 may be formed of an elastic material such as rubber which elastically contacts the inner wall of the toner accommodating portion 92.

As shown in FIG. 4, the plunger 93 may be inserted into the second member 96, the second member 96 may be inserted into the first member 97, and the first member 97 may be inserted into the second portion 91-2 of the body 91.

The guide protrusion 933 penetrates through a side wall 962 of the second member 96 through the guide groove 961 to protrude from the side wall 962 and engages with the spiral portion 971. The packing member 932 is positioned in the toner accommodating portion 92. The plunger 93 is located at a top dead position Q1 in which the packing member 932 is located at a position away from the toner discharge port 94.

In this state, when the toner refill cartridge 9 is inserted into the communication portion 8 as shown in FIG. 1, the toner refill cartridge 9 is connected to the toner filling portion 10 as shown in FIG. 3. The handle 98 is exposed to the outside of the body 91 through the end portion 912 of the body 91. When the handle 98 is turned, the first member 97 is rotated. Thrust in the longitudinal direction A is generated in the guide protrusion 933 by the spiral portion 971. Since the guide protrusion 933 is inserted into the guide groove 961 extending in the longitudinal direction A, the guide protrusion 933 is guided to the guide groove 961 and moved in the longitudinal direction A. The packing member 932 pushes the toner contained in the toner accommodating portion 92 to the outside through the toner discharge port 94. The toner discharged from the toner discharge port 94 may pass through the toner filling portion 10 and be accommodated in the toner accommodating portion 230 in the developing cartridge 2. When the packing member 932 reaches a bottom dead position Q2 as shown in FIG. 6, toner filling is completed.

The maximum angle at which the user may hold the handle 98 and rotate the first member 97 at one time may not exceed 360 degrees, and generally does not exceed about 180 degrees. Therefore, if the pitch of the spiral portion 971 is appropriately selected, a sudden movement of the plunger 93 may be prevented. In addition, if the cross-sectional area of the toner accommodating portion 92 is appropriately selected, a sudden discharge of the toner may be prevented.

For example, if the pitch of the spiral portion 971 is 40 mm and the user rotates the first member 97 180 degrees at a time, the plunger 93 may be moved 20 mm by a rotational operation of rotating the handle 98 once. If the cross-sectional area of the toner accommodating portion 92 is about 400 $mm^2$, about 8 cc of toner is filled into the developing cartridge 2 by one rotational operation. If the length of the toner accommodating portion 92 is 200 mm, ten rotational operations are required to move the plunger 93 from the top dead position Q1 to the bottom dead position Q2. Therefore, since the plunger 93 is moved from the top dead position Q1 to the bottom dead position Q2 by the rotational operation divided into ten times, a sudden discharge of the toner and consequently a toner leakage in the developing cartridge 2 may be prevented.

Figure 7:
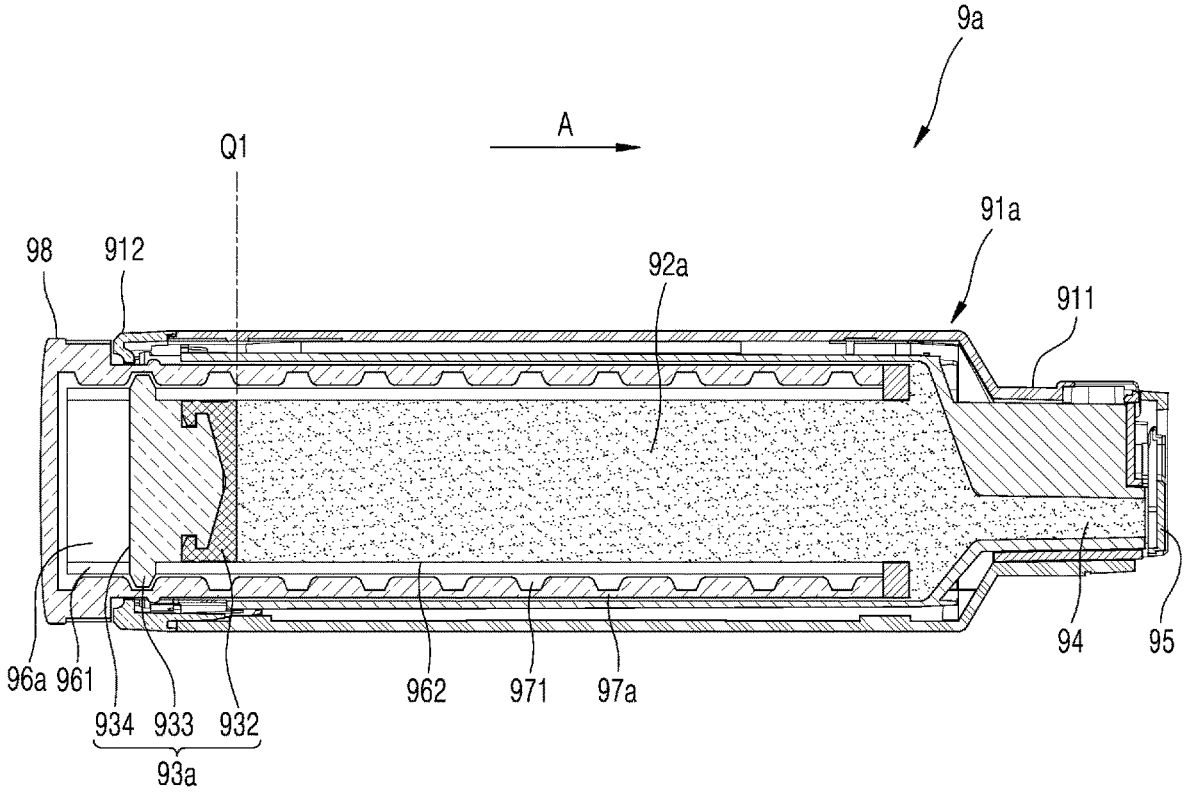
FIG. 7 is a cross-sectional view of a toner refill cartridge showing a state in which a plunger is located at a top dead position according to an example.
Figure 8:
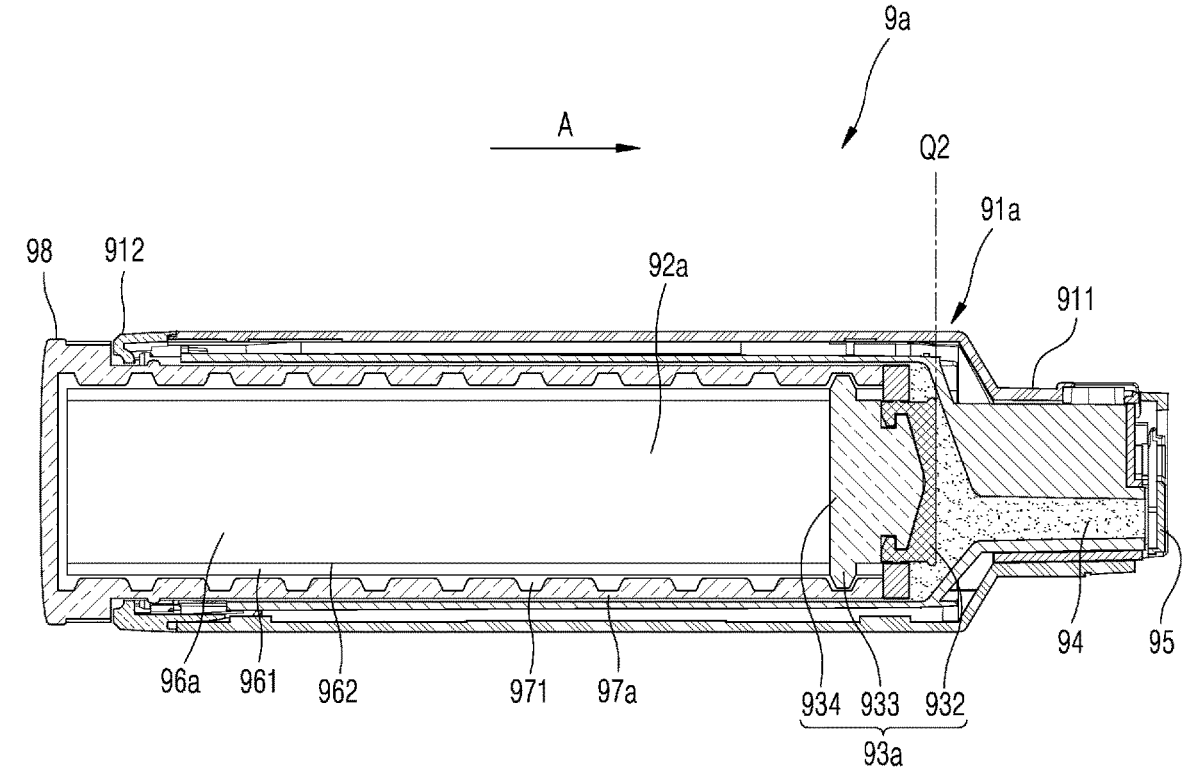
FIG. 8 is a cross-sectional view of a toner refill cartridge showing a state in which a plunger is located at a bottom dead position according to an example.

FIG. 7 is a cross-sectional view of a toner refill cartridge showing a state in which a plunger is located at a top dead position according to an example. FIG. 8 is a cross-sectional view of a toner refill cartridge showing a state in which a plunger is located at a bottom dead position according to an example.

Referring to FIGS. 7 and 8, a toner refill cartridge 9*a* comprises a body 91*a*, a first member 97*a*, a handle 98, a second member 96*a*, and a plunger 93*a*. Compared to the toner refill cartridge 9 shown in FIGS. 4 to 6, the toner refill cartridge 9*a* of this example differs in that the first member 97*a* and the second member 96*a* have a hollow cylindrical shape accommodated in the toner accommodating portion (92 of FIG. 5). In other words, the toner is accommodated inside the second member 96*a*, so that an inner space of the second member 96*a* forms a toner accommodating portion 92*a* in which the toner is accommodated. By such a configuration, the length of the toner refill cartridge 9*a* may be shortened, so that the package size of the toner refill cartridge 9*a* distributed individually as a consumable may be reduced. Therefore, the packaging cost and logistics cost may be reduced.

A toner discharge port 94 is provided at an end portion 911 in the longitudinal direction A of the body 91*a*. The toner discharge port 94 is communicated with the toner accommodating portion 92*a*. The toner accommodating portion 92*a* is communicated with the outside through the toner discharge port 94. A shutter 95 for selectively opening and closing the toner discharge port 94 may be provided at the end portion 911 of the body 91*a*.

The first member 97*a* is rotatably supported by the body 91*a*. A spiral portion 971 is provided in the longitudinal direction A in the first member 97*a*. The first member 97*a* is inserted into the body 91*a* and is rotatably supported by the body 91. The first member 97*a* may have a hollow cylindrical shape. The spiral portion 971 is provided on an inner wall of the first member 97*a*. The spiral portion 971 extends in the longitudinal direction A.

The handle 98 is exposed to the outside of the body 91*a* to rotate the first member 97*a*. The handle 98 is exposed to the outside of the body 91*a* through the end portion 912 of the body 91*a* for the user to hold by hand. The handle 98 may be integrally formed with the first member 97*a* or may be manufactured as a separate member and coupled to the first member 97*a*.

The second member 96*a* is located inside the first member 97*a* and the second member 96*a* may accommodate toner. The second member 96*a* may have a hollow cylindrical shape. The inner space of the second member 96*a* forms the toner accommodating portion 92*a* in which toner may be accommodated. The second member 96*a* comprises a side wall 962 and a guide groove 961 extending in the longitudinal direction A through the side wall 962.

The plunger 93*a* is inserted into the second member 96*a*. The plunger 93*a* comprises a guide protrusion 933 which passes through the guide groove 961 and is engaged with the spiral portion 971. The plunger 93*a* is moved in the longitudinal direction A as the first member 97*a* is rotated to push the toner inside the second member 96*a* toward the toner discharge port 94.

In one example, the plunger 93*a* may include a moving member 934 provided with the guide protrusion 933 and a packing member 932 provided on the moving member 934 and in contact with the inner wall of the second member 96*a*. The moving member 934 is inserted into the second member 96*a*. The packing member 932 pushes the toner inside the second member 96*a* toward the toner discharge port 94 when the moving member 934 is moved in the longitudinal direction A toward the end portion 911. The packing member 932 may be formed of an elastic material such as rubber or the like, which elastically contacts the inner wall of the second member 96*a*.

As shown in FIG. 7, the plunger 93*a* may be inserted into the second member 96*a*, the second member 96*a* may be inserted into the first member 97*a*, and the first member 97*a* may be inserted into the body 91*a*. The guide protrusion 933 penetrates through the side wall 962 of the second member 96*a* through the guide groove 961 to protrude from the side wall 962 and engages with the spiral portion 971. The plunger 93*a* is located at the top dead position Q1 inside the toner accommodating portion 92*a*. The top dead position Q1 is a position at which the packing member 932 is away from the toner discharge port 94, that is, a position adjacent to the end portion 912.

In this state, when the toner refill cartridge 9*a* is inserted into the communication portion 8 as shown in FIG. 1, the toner refill cartridge 9*a* is connected to the toner filling portion 10 as shown in FIG. 3. The handle 98 is exposed to the outside of the body 91*a* through the end portion 912 of the body 91*a*. When the handle 98 is turned, the first member 97*a* is rotated. Thrust in the longitudinal direction A is applied to the guide protrusion 933 by the spiral portion 971. Since the guide protrusion 933 is inserted into the guide groove 961 extending in the longitudinal direction A, the guide protrusion 933 is guided to the guide groove 961 and moved in the longitudinal direction A. The packing member 932 pushes toner contained in the second member 96*a* to the outside through the toner discharge port 94. The toner discharged from the toner discharge port 94 may pass through the toner filling portion 10 and be accommodated in the toner accommodating portion 230 inside the developing cartridge 2. When the packing member 932 reaches the bottom dead position Q2 as shown in FIG. 8, toner filling is completed.

By such a configuration, a sudden movement of the plunger 93*a* and a sudden discharge of the toner may be prevented. In addition, the toner refill cartridge 9*a* of this example is shorter in length than the toner refill cartridge 9 shown in FIGS. 4 to 6. Accordingly, the packaging size of the toner refill cartridge 9*a* which is distributed individually as a consumable may be reduced, so that the packaging cost and the logistics cost may be reduced.

Figure 9:
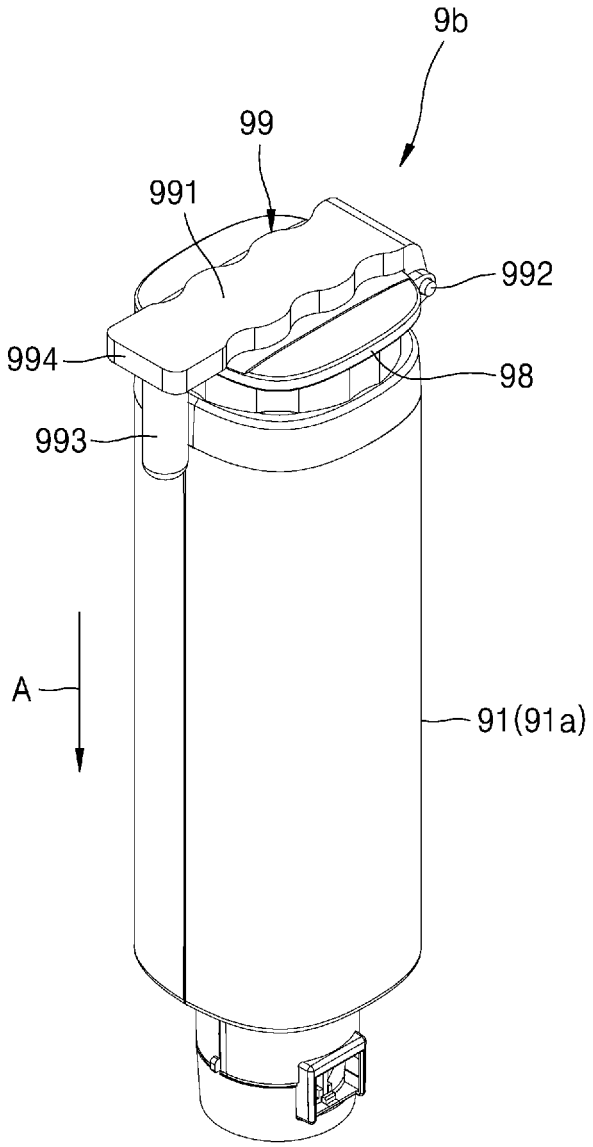
FIG. 9 is a perspective view of a toner refill cartridge showing a state in which an extension handle is positioned at a first position according to an example.
Figure 10:
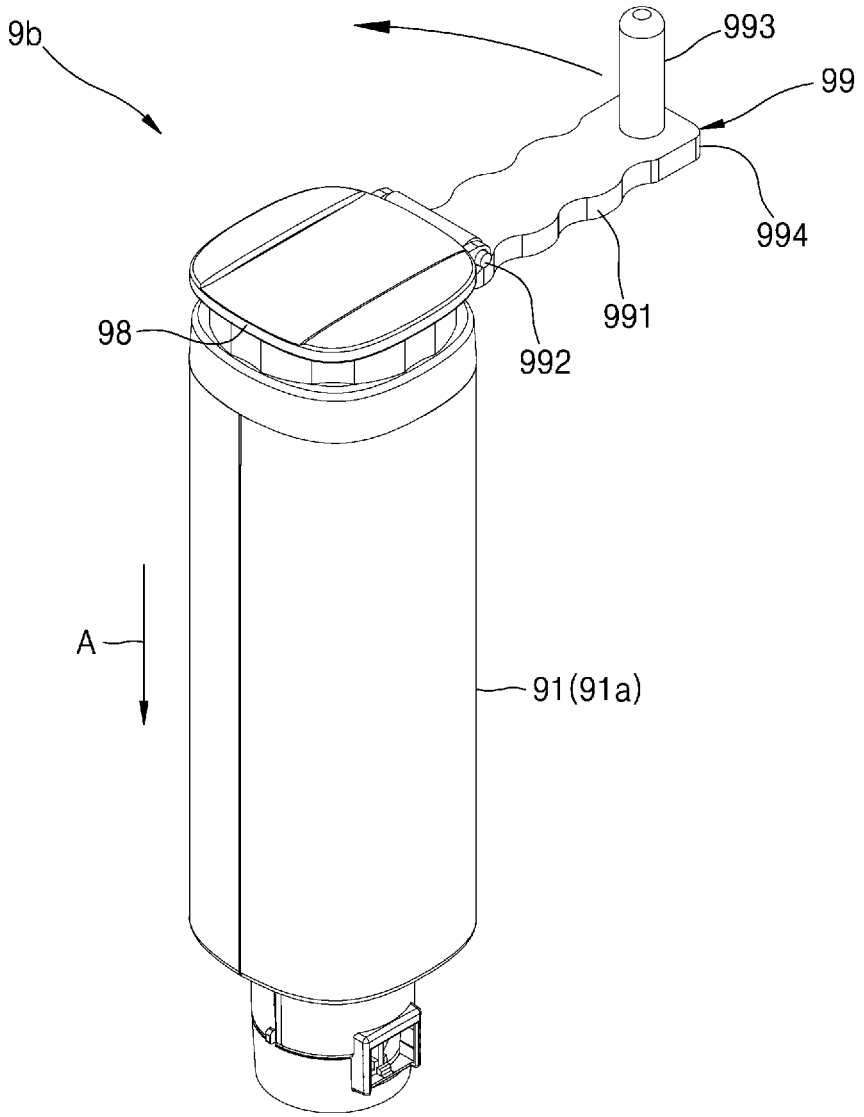
FIG. 10 is a perspective view of a toner refill cartridge showing a state in which an extension handle is positioned at a second position according to an example.

FIG. 9 is a perspective view of a toner refill cartridge showing a state in which an extension handle is located at a first position according to an example. FIG. 10 is a perspective of a toner refill cartridge showing a state in which an extension handle is located at a second position according to an example.

Referring to FIGS. 9 and 10, the toner refill cartridge 9*b* differs in that an extension handle 99 is provided as compared with the toner refill cartridge 9 shown in FIGS. 4 to 6 and the toner refill cartridge 9*a* shown in FIGS. 7 and 8. Therefore, hereinafter, a repetitive description will be omitted and the differences will be described.

Referring to FIGS. 9 and 10, the handle 98 has the extension handle 99 that may be switched to a first position (see FIG. 9) folded in the handle 98 and a second position (see FIG. 10) extending outward from the handle 98. The extension handle 99 may be applied to the toner refill cartridge 9 and the toner refill cartridge 9*a*. The extension handle 99 extends the area of the handle 98 to the outside of the handle 98 so that the user may hold the handle 98 and easily rotate the first members 97 and 97*a*.

In one example, the extension handle 99 may be connected to the handle 98 to be rotated to the first and second positions. The extension handle 99 may have a rotating portion 991. The rotating portion 991 may be rotatably connected to the handle 98 through a hinge 992. The hinge 992 may be provided near the edge of the handle 98. In the first position, the rotating portion 991 is folded to an upper surface of the handle 98. Therefore, an increase in the size of the toner refill cartridge 9*b* due to the extension handle 99 may be minimized.

As shown in FIG. 10, in the second position, the rotating portion 991 is rotated about the hinge 992 and extends from the hinge 992 to the outside of the handle 98. The edge of the handle 98 extends outward by the length of the rotating portion 991. Accordingly, the user may hold the rotating portion 991 and easily rotate the handle 98.

The extension handle 99 may further include an extension portion 993 extending in the longitudinal direction A from the rotating portion 991. An end portion 994 of the rotating portion 991 opposite to the hinge 992 may extend beyond the edge of the handle 98. The extension portion 993 may extend in the longitudinal direction A from the opposite end portion 994 of the rotating portion 991. By such a configuration, as shown in FIG. 9, in the first position, the extension portion 993 does not interfere with the bodies 91 and 91*a*. In the second position, as shown in FIG. 10, the rotating portion 991 is rotated about the hinge 992 and extends from the hinge 992 to the outside of the handle 98, and the extension portion 993 extends in a direction opposite to the longitudinal direction A from the opposite end portion 994 of the rotating portion 991. The user may hold the extension portion 993 and easily rotate the handle 98.

It should be understood that examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope

What is claimed is:

1. A toner refill cartridge comprising:

a body having a toner accommodating portion to accommodate toner, and a toner discharge port provided at an end portion of the body in a longitudinal direction to be in communication with the toner accommodating portion;

a first member rotatably supported by the body and having a spiral portion extending in the longitudinal direction;

a second member located inside the first member and having a guide groove extending in the longitudinal direction; and a plunger having a guide protrusion which passes through the guide groove and is engaged with the spiral portion, the plunger to push toner inside the toner accommodating portion toward the toner discharge port while being moved in the longitudinal direction as the first member is rotated.

2. The toner refill cartridge of claim 1, wherein the body has a first portion including the toner accommodating portion, and a second portion extending from the first portion to an opposite side of the toner discharge port to accommodate the first member, the second member, and the plunger.

3. The toner refill cartridge of claim 2, wherein the plunger comprises:

a piston having the guide protrusion and extending from an inner side of the second member to an inner side of the toner accommodating portion; and a packing member provided at an end portion of the piston to be in contact with an inner wall of the toner accommodating portion.

4. The toner refill cartridge of claim 3, further comprising a communication port at an end portion of the second member on a side of the toner accommodating portion, wherein the piston passes through the communication port while the plunger is being moved in the longitudinal direction as the first member is rotated.

5. The toner refill cartridge of claim 1, wherein each of the first member and the second member has a hollow cylindrical shape and is accommodated in the toner accommodating portion, and wherein the toner is accommodated in the second member.

6. The toner refill cartridge of claim 5, wherein the plunger comprises:

a moving member provided with the guide protrusion; and a packing member provided on the moving member and in contact with an inner wall of the second member.

7. The toner refill cartridge of claim 1, wherein the first member has a handle exposed to the outside of the body to rotate the first member.

8. The toner refill cartridge of claim 7, wherein the handle includes an extension handle that is movable between a first position at which the extension handle is folded onto the handle and a second position at which the extension handle extends outward from the handle.

9. The toner refill cartridge of claim 8, wherein the extension handle is connected to the handle to be pivotable between the first position and the second position.

10. The toner refill cartridge of claim 8, wherein the extension handle comprises:

a rotating portion connected to the handle to be rotated to the first and second positions; and an extension portion extending in the longitudinal direction from the rotating portion.

11. A toner refill cartridge comprising:

a body having a toner discharge port provided at an end portion of the body in a longitudinal direction;

a first member rotatably supported inside the body and having a spiral portion extending in the longitudinal direction on an inner wall of the first member;

a handle exposed to the outside of the body to rotate the first member;

a second member having a side wall and a guide groove penetrating through the side wall and extending in the longitudinal direction, located inside the first member, and to accommodate toner therein; and a plunger inserted into the second member, having a guide protrusion which passes through the guide groove to engage the spiral portion, and to push the toner inside the second member toward the toner discharge port while being moved in the longitudinal direction as the first member is rotated.

12. The toner refill cartridge of claim 11, wherein the plunger comprises:

a moving member inserted into the second member and provided with the guide protrusion; and a packing member provided on the moving member to be in contact with an inner wall of the second member.

13. The toner refill cartridge of claim 11, wherein the handle includes an extension handle that is movable between a first position to be folded in the handle and a second position to extend outward from the handle.

14. The toner refill cartridge of claim 13, wherein the extension handle is connected to the handle to be rotated to the first position and the second position.

15. The toner refill cartridge of claim 13, wherein the extension handle comprises:

a rotating portion connected to the handle to be rotated to the first and second positions; and an extension portion extending in the longitudinal direction from the rotating portion.

* * * * *